US008217853B2

(12) United States Patent
Tai et al.

(10) Patent No.: US 8,217,853 B2
(45) Date of Patent: Jul. 10, 2012

(54) ELECTRICAL CONNECTOR ASSEMBLY WITH ANTENNA FUNCTION

(75) Inventors: Lung-Sheng Tai, Tu-cheng (TW); Wen-Fong Su, Tu-cheng (TW); Hsieh-Sheng Tseng, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 780 days.

(21) Appl. No.: 12/319,081

(22) Filed: Dec. 30, 2008

(65) Prior Publication Data

US 2009/0167631 A1 Jul. 2, 2009

(30) Foreign Application Priority Data

Dec. 31, 2007 (TW) ..... 96151059 A

(51) Int. Cl.
*H01Q 1/50* (2006.01)

(52) U.S. Cl. ..... 343/906; 343/700 MS

(58) Field of Classification Search ..... 343/700 MS, 343/702, 841, 906; 439/607, 916
See application file for complete search history.

(56) References Cited

U.S. PATENT DOCUMENTS

| | | | | |
|---|---|---|---|---|
| 5,585,806 | A * | 12/1996 | Ogino et al. | 343/700 MS |
| 6,184,834 | B1 * | 2/2001 | Utsumi et al. | 343/702 |
| 6,639,560 | B1 * | 10/2003 | Kadambi et al. | 343/700 MS |
| 6,786,769 | B2 * | 9/2004 | Lai | 439/607.01 |
| 2008/0136716 | A1 * | 6/2008 | Annamaa et al. | 343/702 |

FOREIGN PATENT DOCUMENTS

CN 200979909 Y 11/2007

* cited by examiner

*Primary Examiner* — Tan Ho
(74) *Attorney, Agent, or Firm* — Wei Te Chung; Andrew C. Cheng; Ming Chieh Chang

(57) ABSTRACT

An electrical connector assembly (100) with antenna function comprising: a PCB (50) comprising a feeding circuit and a grounding circuit; an electrical connector (20) installed on the PCB comprising a metal shell (21) electrically connecting to the grounding circuit; a metal patch (30) connecting to the metal shell comprising a radiating element (33) and a connecting element (31); the radiating element electrical connecting to the feeding circuit; the connecting element connecting the radiating element and the metal shell; the radiating element, the connecting element, and the metal shell forming an antenna that serves as a medium for transmission and reception of electromagnetic signals.

17 Claims, 4 Drawing Sheets

ELECTRICAL CONNECTOR ASSEMBLY WITH ANTENNA FUNCTION

BACKGROUND OF THE INVENTION

1. Field of the Invention

The present invention relates to an electrical connector assembly, and more particularly to electrical connector assembly having antenna function.

2. Description of Prior Art

Personal computer technologies have been embraced in many portable electronics devices including: cellular telephones, personal data assistants (PDAs), laptop computers, MP3 players, pen-drives, digital video cameras, as well as other mobile devices. Many of the portable electronic devices can be configured to operate with various peripheral devices such as a computer mouse, a computer writing tablet, a digital camera, as well as others. Moreover, many of the portable electronic devices are also configured to interface with personal computers through a standard interface.

The need for standardization in computer related interfaces, as well as the need for high-speed communication interfaces has lead to the development of the universal serial bus (USB). The USB interface is a high-speed communication protocol that permits devices to communicate at data rates on the order of 48 Mb/s. A revised USB interface such as the USB 2.0 specification can operate at even higher speeds that are on the order of 480 Mb/s. The high speed USB interface has lead to widespread acceptance of external peripheral devices such as USB HDD systems, USB Ethernet devices, USB compact disk writing devices (e.g., CD/RW), as well as other devices.

Today, more and more electronic devices, such as personal computers, notebook computers, electronic appliances, and the like, are normally equipped with an internal antenna that serves as a medium for transmission and reception of electromagnetic signals, such as date, audio, image, and so on. PIFA (Planar Inverted-F Antenna) is a kind of minitype antenna usually used in the electronic devices. PIFA has compact structure, light weight, perfect impedance match, desired horizontal polarization and vertical polarization, and is easy to achieve multifrequency. So, more and more PIFAs are used in the electronic devices. Electrical connector assembly and the antenna of the traditional electronic devices are two separate components. Accordingly, the electrical connector and the antenna respectively occupy inner space of the electronic devices. However, electronic devices trend to miniaturization developing. For saving inner space of the electronic devices, many components being integrated is a question.

Hence, in this art, an electrical connector assembly with antenna function to overcome the above-mentioned disadvantages of the prior art will be described in detail in the following embodiment.

SUMMARY OF THE INVENTION

An object of the present invention is to provide an electrical connector assembly which has antenna function.

To achieve the aforementioned object, the present invention provides an electrical connector assembly with antenna function comprising: a PCB comprising a feeding circuit and a grounding circuit; an electrical connector installed on the PCB comprising a metal shell electrically connecting to the grounding circuit; a metal patch connecting to the metal shell comprising a radiating element and a connecting element; the radiating element electrical connecting to the feeding circuit; the connecting element connecting the radiating element and the metal shell; the radiating element, the connecting element, and the metal shell forming an antenna that serves as a medium for transmission and reception of electromagnetic signals.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
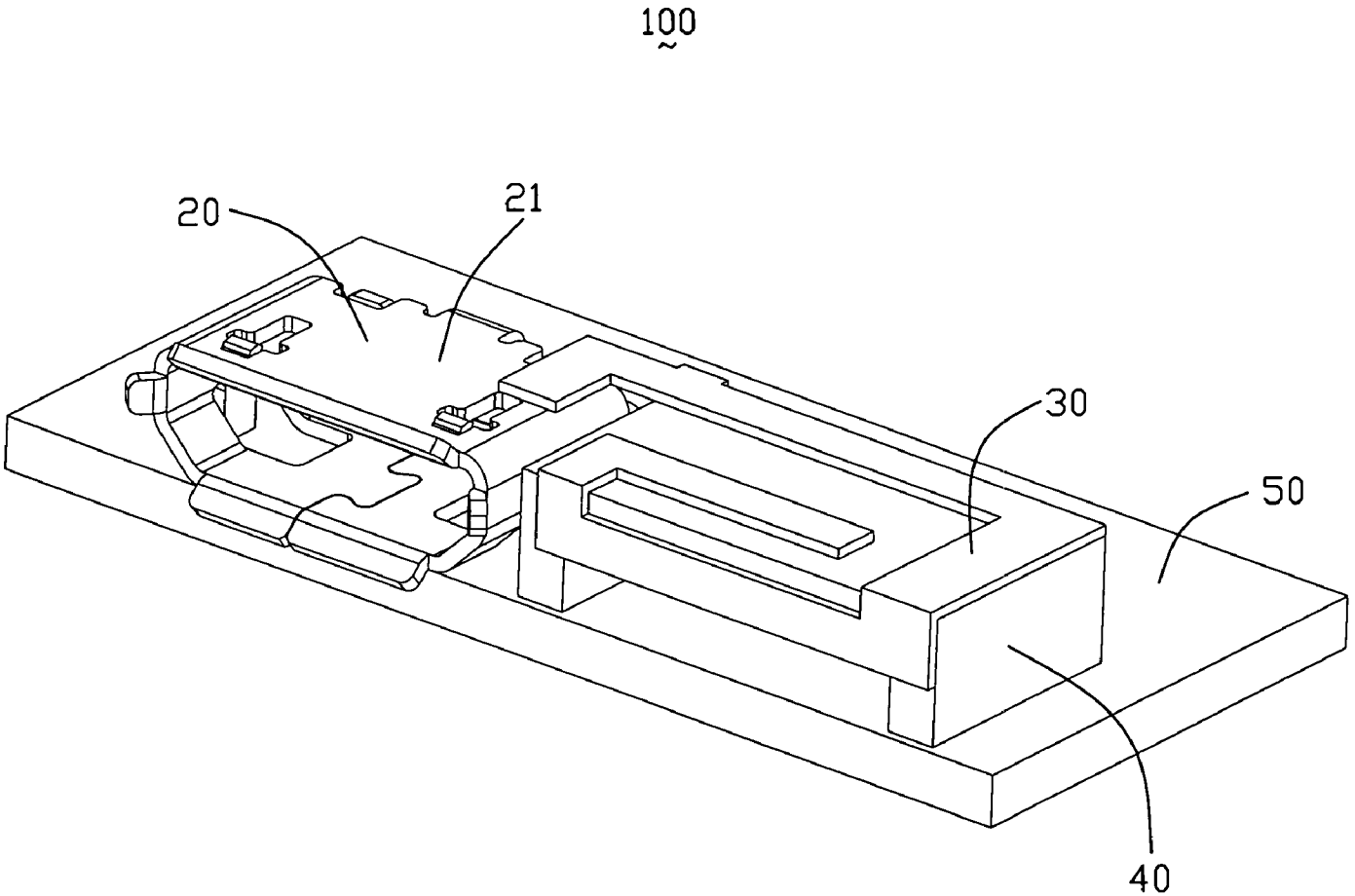
FIG. 1 is a perspective view of an electrical connector assembly with antenna in accordance with a preferred embodiment of the present invention.
Figure 2:
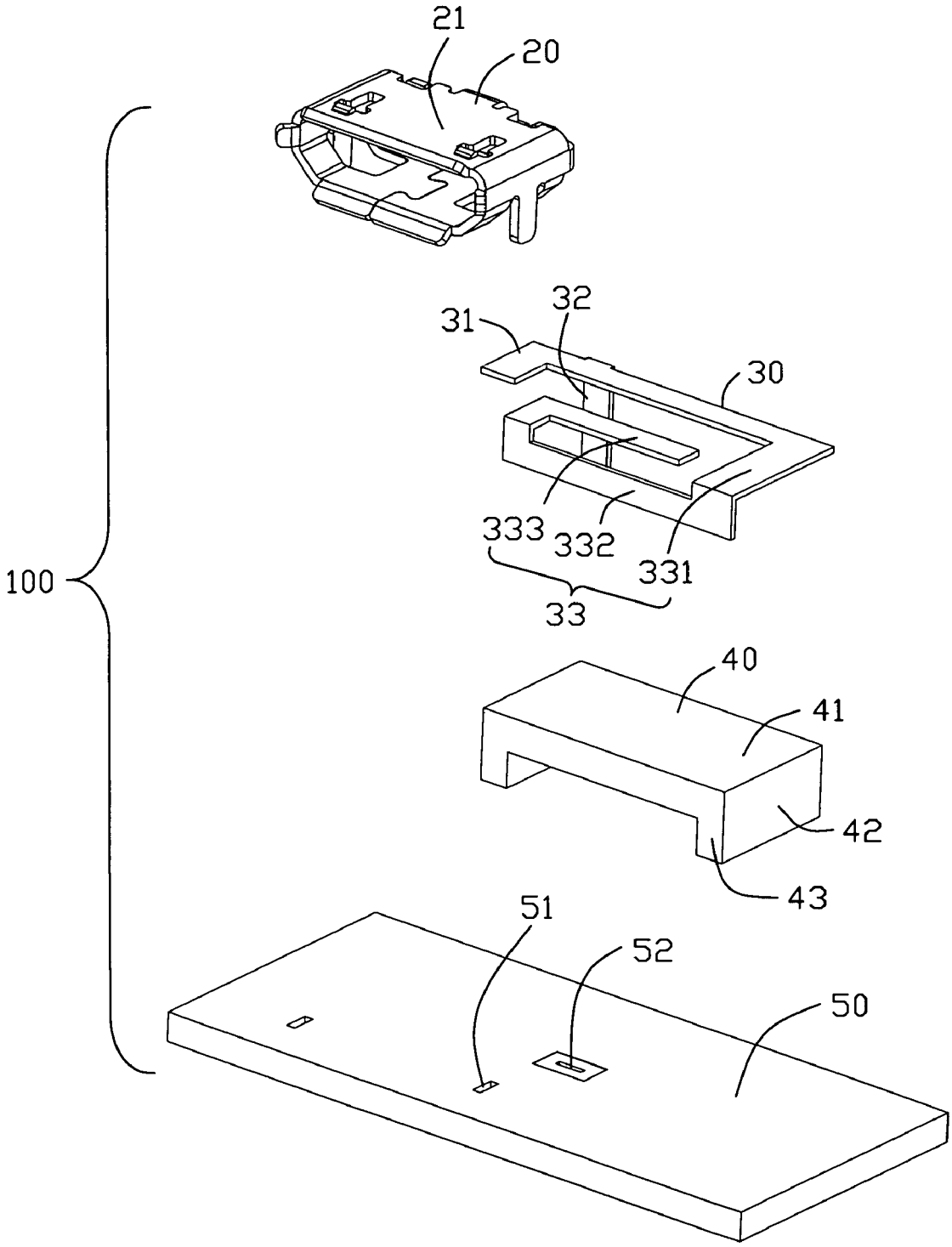
FIG. 2 is an exploded, perspective view of FIG. 1.
Figure 3:
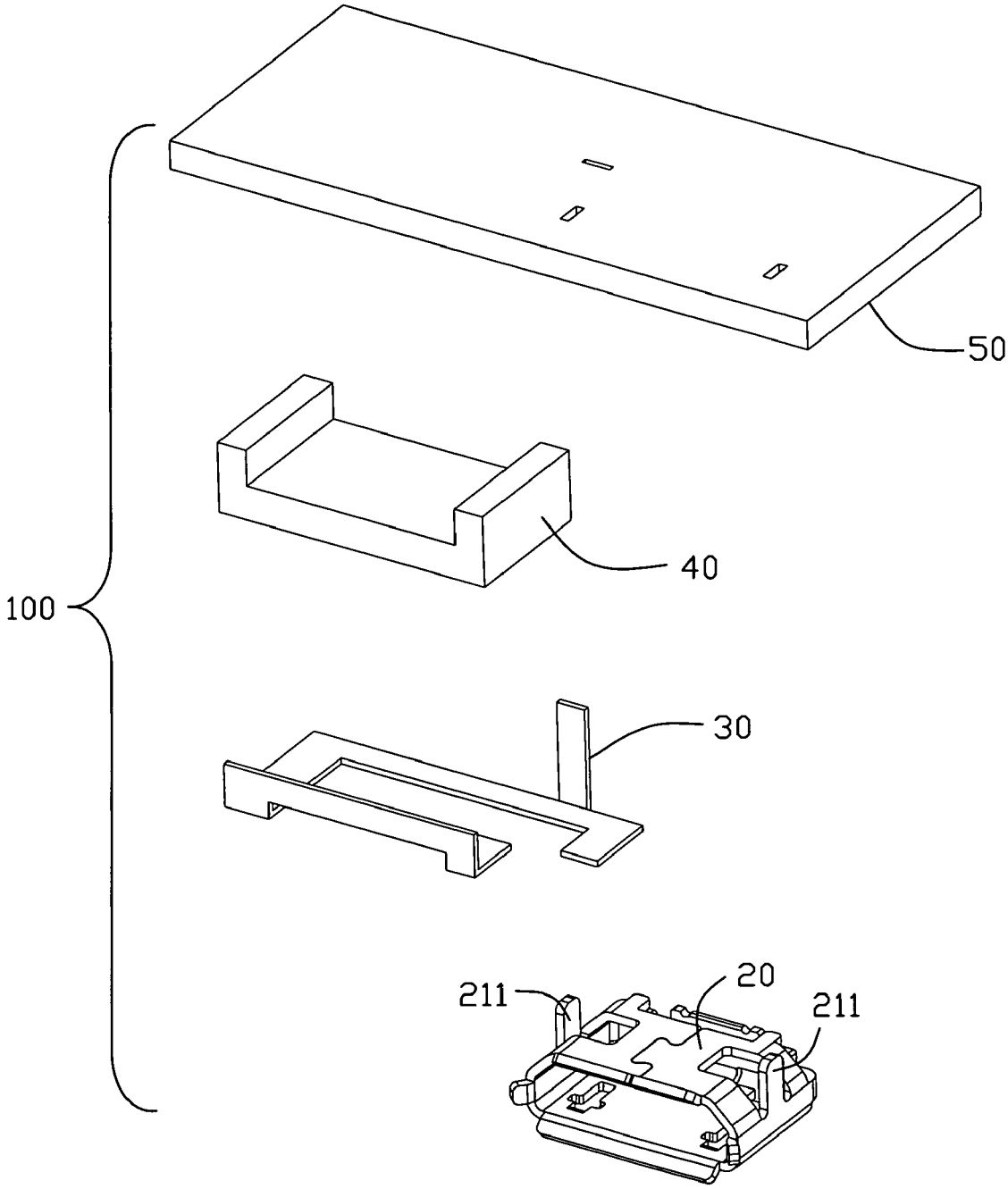
FIG. 3 is a view similar to FIG. 2, but from a different aspect.

Referring to FIGS. 1-3, an electrical connector assembly 100 with antenna function in accordance with a first embodiment of the present invention comprises a micro USB electrical connector 20, a metal patch 30, an insulating support element 40, and a PCB 50.

The USB electrical connector 20 comprises an insulating body (not shown), several contacts (not shown) received in the insulating body, and a metal shell 21 covering the insulating body. The metal shell 21 comprises a welding element 211 extending vertically and downwardly from a bottom surface of the metal shell 21.

The metal patch 30 connects to the metal shell 21 of the USB connector 20. Accordingly, the metal patch 30 and the metal shell form an antenna that serves as a medium for transmission and reception of electromagnetic signals. The metal patch 30 comprises an L-shape connecting element 31 lying in a first plane and connecting to the metal shell 21, a radiating element 33 connecting to the connecting element 31, a feeding element 32 extending from a joint of the connecting element 31 and the radiating element 33. The radiating element 33 comprises a first L-shape radiating branch 331 lying in the first plane, a second inverted n-shape radiating branch 332 lying in a second plane and extending from an end of the first radiating branch 331, and a third L-shape radiating branch 333 lying in the first plane. The first plane is vertical to the second plane. The feeding element 32 is vertical to the radiating branch 331. The electrical connector assembly is mounted on the PCB 50. The welding element 211 of the electrical connector 20 and the feeding element 32 are soldered respectively to suitable circuit of the PCB 50.

The insulating support element 40 having n-shape comprises a main body 41 and two vertical element 42 extending vertically and downwardly from two side of the main body 41. The first radiating branch 331 and the third radiating branch 333 locate on the top surface of the main body 41. The second radiating branch 332 of the radiating element 30 clings to a front surface 43 of the insulating support element 40.

The PCB 50 comprises a pair of first slot 51 for receiving the welding element 211, a second slot 52 for receiving the feeding element 32, and feeding circuit and grounding circuit (not shown). The metal shell 21 electrically connects to the grounding circuit. The radiating element 30 electrically connects to the feeding circuit.

The electrical connector 20 of the present invention is not limited to the micro USB connector of the first embodiment, other types electrical connector as well as used in present invention, such as USB connector, HDMI connector, IEEE 1394 connector and so on.

Figure 4:
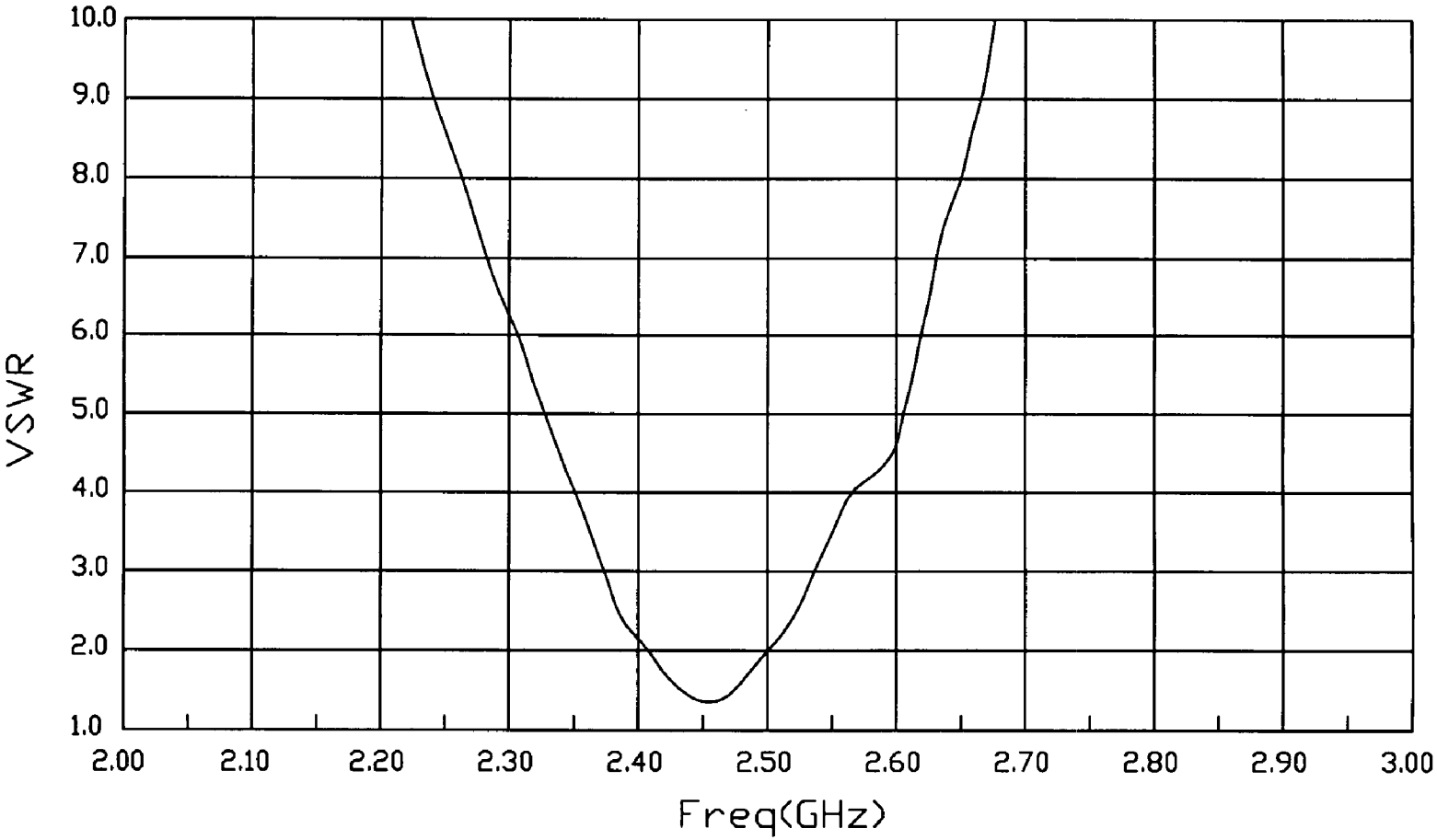
FIG. 4 is a test chart recording for the antenna of the in accordance with a preferred embodiment of the present invention, showing Voltage Standing Wave Ratio (VSWR) of frequency band.

FIG. 4 is a test chart of Voltage Standing Wave Ratio of the electrical connector assembly 100 as an antenna. Referring to FIG. 4, operating frequency band of the electrical connector assembly 100 as an antenna are 2.4 GHz-2.5 GHz.

What is claimed is:

1. An electrical connector assembly with antenna function comprising:

a PCB comprising a feeding circuit and a grounding circuit;

an electrical connector installed on the PCB comprising a metal shell electrically connecting to the grounding circuit;

a metal patch connecting to the metal shell comprising a radiating element and a connecting element; and an insulating support element between the PCB and the metal patch, said insulating support element being n-shape and comprising a main body, a front surface, and two vertical elements extending vertically and downwardly from two sides of the main body; wherein the radiating element electrically connects to the feeding circuit; the connecting element connects the radiating element and the metal shell; the radiating element, the connecting element, and the metal shell form an antenna that serves as a medium for transmission and reception of electromagnetic signals.

2. The electrical connector assembly as claimed in claim 1, wherein said metal patch locates in a side of the metal shell.

3. The electrical connector assembly as claimed in claim 1, wherein said metal shell comprises a pair of welding elements soldered to the PCB.

4. The electrical connector assembly as claimed in claim 1, wherein said connecting element and the radiating element have a joint, a feeding element extends vertically and downwardly from the joint.

5. The electrical connector assembly as claimed in claim 4, wherein said feeding element is soldered to the PCB and electrically connects to the feeding circuit.

6. The electrical connector assembly as claimed in claim 1, wherein said radiating element comprises a first radiating branch lying in a first plane, a second inverted n-shape radiating branch lying in a second plane, and a third L-shape radiating branch lying in the first plane; the second radiating branch connects the first radiating branch and the third radiating branch.

7. The electrical connector assembly as claimed in claim 6, wherein said the first plane is vertical to the second plane.

8. The electrical connector assembly as claimed in claim 6, wherein said first and third radiating branches locate on top surface of the main body of the insulating support element; the second radiating branch clings to a front surface of the insulating support element.

9. An electrical connector assembly comprising:

a printed circuit board;

an electrical connector seated upon the printed circuit board and having contacts and an insulative housing thereof, said connector further defining a mating opening enclosed by a metallic shell which defines at least one leg mechanically and electrically connected to the printed circuit board for grounding;

a metallic antenna being discrete from and outside of the shell and located transversely beside the connector in a side-by-side manner, said antenna performing radiation with a first portion engaged with the shell for grounding and a second portion engaged with a feeding circuit on the printed circuit board for feeding.

10. The assembly as claimed in claim 9, further comprising an insulating support element mounted upon the printed circuit board and beside the connector to support the antenna.

11. The assembly as claimed in claim 9, wherein the connector and the support element have a similar height.

12. The assembly as claimed in claim 9, wherein said antenna is a stripe type, and the first portion and the second portion are both located around one end of said antenna.

13. The assembly as claimed in claim 12, wherein said first portion of the antenna engages a top wall of the shell.

14. An electrical connector assembly comprising:

a printed circuit board;

an electrical connector seated upon the printed circuit board and including a metallic shell enclosing an insulative housing and a plurality of internal contacts therein;

a metallic antenna being discrete and outside of from the metallic shell and supportably standing upon the printed circuit board transversely beside the connector in a side-by-side manner, wherein a first portion of the antenna is linked to the shell for grounding, a second portion of the antenna is linked to a feeding source, and remaining portions other than the first portion and the second portion, extending above the printed circuit board for radiating.

15. The assembly as claimed in claim 14, wherein said antenna is a stripe type.

16. The assembly as claimed in claim 15, wherein said antenna is supported by an insulating support element which is seated upon the printed circuit board beside the connector.

17. The assembly as claim 14, wherein said first portion of the antenna engages a top wall of the shell.

* * * * *